US008741103B2

(12) United States Patent
Shimada et al.

(10) Patent No.: US 8,741,103 B2
(45) Date of Patent: Jun. 3, 2014

(54) BIOMASS-DERIVED POLYESTER STAPLE FIBERS AND WET-LAID NONWOVEN FABRIC FORMED FROM THE SAME

(75) Inventors: Kazumasa Shimada, Ehime (JP); Hironori Goda, Ehime (JP); Kenji Inagaki, Osaka (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 13/824,492

(22) PCT Filed: Oct. 25, 2011

(86) PCT No.: PCT/JP2011/074485

§ 371 (c)(1),
(2), (4) Date: Apr. 24, 2013

(87) PCT Pub. No.: WO2012/057105

PCT Pub. Date: May 3, 2012

(65) Prior Publication Data

US 2013/0199744 A1 Aug. 8, 2013

(30) Foreign Application Priority Data

Oct. 27, 2010 (JP) ..... 2010-241010

(51) Int. Cl.
*D21F 11/00* (2006.01)

(52) U.S. Cl.
USPC ..... 162/141; 428/375

(58) Field of Classification Search
USPC ..... 162/141, 157.3; 428/375, 364, 359; 28/104
See application file for complete search history.

(56) References Cited

U.S. PATENT DOCUMENTS

| | | | | |
|---|---|---|---|---|
| 5,364,694 | A * | 11/1994 | Okada et al. | 442/347 |
| 6,686,303 | B1 * | 2/2004 | Haynes et al. | 442/327 |
| 2004/0265577 | A1 * | 12/2004 | Goda | 428/364 |
| 2007/0098986 | A1 * | 5/2007 | Goda | 428/375 |

FOREIGN PATENT DOCUMENTS

| | | | |
|---|---|---|---|
| CN | 101046007 | A | 10/2007 |
| JP | 2009-091694 | A | 4/2009 |
| JP | 2009-150017 | A | 7/2009 |
| JP | 2009-221611 | A | 10/2009 |
| JP | 2010-180492 | A | 8/2010 |

OTHER PUBLICATIONS

JP 2000-221611, Machine translation, Oct. 2009.*

* cited by examiner

*Primary Examiner* — Mark Halpern
(74) *Attorney, Agent, or Firm* — Sughrue Mion, PLLC

(57) ABSTRACT

The present invention has an object to provide staple fibers suitable for manufacturing a wet-laid nonwoven fabric having excellent adhesive strength and heat resistance at a reduced environmental burden, a manufacturing method of the same, and a nonwoven fabric using the staple fibers. The object can be achieved by polyalkylene terephthalate or polyalkylene naphthalate staple fiber wet nonwoven fabric having excellent adhesive strength and heat resistance that are provided by blending and thermal-compression bonding of low oriented yarn and fully oriented yarn, wherein a specific ratio of biomass-derived carbon, fineness, fiber length, and a weight ratio between fully oriented staple fibers and low oriented staple fibers in the wet-laid nonwoven fabric are used to obtain a fine low oriented yarn having excellent binder performance and a fine fully oriented yarn having an unprecedented level of fineness.

3 Claims, No Drawings

BIOMASS-DERIVED POLYESTER STAPLE FIBERS AND WET-LAID NONWOVEN FABRIC FORMED FROM THE SAME

CROSS REFERENCE TO RELATED APPLICATIONS

This application is a National Stage of International Application No. PCT/JP2011/074485filed Oct. 25, 2011 (claiming priority based on Japanese Patent Application No. 2010-241010filed Oct. 27, 2010), the contents of which are incorporated herein by reference in their entirety.

TECHNICAL FIELD

The present invention provides wet-laid nonwoven fabric using polyalkylene terephthalate staple fibers and/or polyalkylene naphthalate staple fibers having a biomass-derived carbon ratio of 10% or more and 100% or less by the radioactive carbon measurement (carbon 14, one of radioisotopes of the carbon atom and has 6 protons and 8 neutrons in the nucleus. The same applies to the following), single fiber fineness of 0.0001 to 7.0 decitex, and a fiber length of 0.1 to 20 mm and a manufacturing method of the same.

BACKGROUND ART

Recently, the amount used for synthetic fiber paper obtained by a web forming method using polyethylene terephthalate fibers for a part or the whole of a material of paper has been increasing owing to its excellent physical characteristics such as mechanical characteristics, electric characteristics, heat resistance, dimensional stability, hydrophobic nature and the like and cost advantages. As a binder fiber used for the synthetic fiber paper, polyethylene fibers and polyvinyl alcohol fibers were used in the past but polyethylene terephthalate fibers are mainly used at present. For the synthetic fiber paper mainly using polyethylene terephthalate fibers, the same kind of polyethylene terephthalate fibers are mainly used as an optimal binder. Moreover, in recent years, in the fields of heat-retaining materials, electrical insulating materials, filters, medical materials, construction materials and the like, a demand for development of wet-laid nonwoven fabrics having heat resistance has become high. Thus, a wet-laid nonwoven fabric formed of fibers using polyethylene naphthalate which is one of polyesters having higher heat resistance as a material has been developed (See Patent Literature 1, for example).

However, depletion of petroleum and wood has become a serious social problem in recent years, and sustainable development is given importance. Thus, a wet-laid nonwoven fabric using a polylactic acid fiber which is a biomass-derived component is proposed (See Patent Literature 2, for example). However, with such a wet-laid nonwoven fabric, the melting point of polylactic acid which is a polymer is as low as in the vicinity of 170° C., hydrolyzability is low, and fully satisfactory values of adhesive strength and heat resistance of the wet-laid nonwoven fabric have not been obtained.

Patent Literature 1: Japanese Unexamined Patent Application Publication No. 2009-221611

Patent Literature 2: Japanese Unexamined Patent Application Publication No. 2010-180492

SUMMARY OF THE INVENTION

Problems to be Solved by the Invention

The present invention was made in view of the above-described background and has an object to provide staple fibers that are used suitably for a wet-laid nonwoven fabric having excellent tensile strength and heat resistance while reducing an environmental burden, a wet-laid nonwoven fabric and a manufacturing method of the wet-laid nonwoven fiber.

Means for Solving the Problems

As the result of keen studies in order to achieve the above object, the present inventors have invented fully oriented staple fibers and low oriented staple fibers having specific biomass-derived carbon ratio, fineness, and fiber length. Moreover, the inventors have found out that a polyalkylene terephthalate staple fiber wet-laid nonwoven fabric or polyalkylene naphthalate staple fiber wet-laid nonwoven fabric having excellent adhesive strength and heat resistance can be manufactured by using the fully oriented staple fibers and the low oriented staple fibers at a specific weight ratio. Furthermore, the inventors have found out that, since the low oriented staple fibers are fine low oriented staple fibers having excellent binder performance, that is, thermal adhesiveness, the wet-laid nonwoven fabric can be manufactured by a manufacturing method of blending and thermal-compression bonding the fine fully oriented staple fibers and these fine low oriented staple fibers and reached the series of inventions in the present application.

That is, one invention of the present application is polyalkylene terephthalate staple fibers in which a biomass-derived carbon ratio by radioactive carbon (carbon 14) measurement is 10% or more and 100% or less, single fiber fineness is 0.0001 to 7.0 decitex, and a fiber length is 0.1 to 20 mm or polyalkylene naphthalate staple fibers in which a biomass-derived carbon ratio by radioactive carbon (carbon 14) measurement is 10% or more and 100% or less, single fiber fineness is 0.0001 to 7.0 decitex, and a fiber length is 0.1 to 20 mm. Another invention of the present application is a wet-laid nonwoven fabric containing the polyalkylene terephthalate low oriented staple fibers or polyalkylene naphthalate low oriented staple fibers satisfying the matters presented above by 15 mass % or more or a wet-laid nonwoven fabric composed only of one or two types or more of polyalkylene terephthalate staple fibers or one or two types or more of polyalkylene naphthalate staple fibers satisfying the matters presented above and containing the above-described low oriented staple fibers by 15 mass % or more. Still another invention of the present application is a manufacturing method of a wet-laid nonwoven fabric in which fully oriented staple fibers (A) and low oriented staple fibers (B) are mixed and subjected to web forming and then, subjected to heat treatment by a drum dryer or an air-through dryer and further to the heat treatment by a calender roll as necessary.

Advantageous Effects of the Invention

According to the present invention, compared with wet-laid nonwoven fabrics made of polyethylene terephthalate and polylactic acid which have been examined, a polyalkylene terephthalate staple fiber wet-laid nonwoven fabric or a polyalkylene naphthalate staple fiber wet-laid nonwoven fabric having excellent tensile strength and heat resistance and a reduced environmental burden can be provided. Those wet-laid nonwoven fabrics are suitably used for applications such as bag filters, electrical insulating material of F class or above in heat resistance class, separators for batteries, separators for capacitor (super capacitor), ceiling materials, floor mats, engine filters, oil filters and the like. Moreover, wide applications to nonwoven fabric materials for vehicle requiring heat resistance and chemical resistance are expected.

BEST MODE FOR CARRYING OUT THE INVENTION

An embodiment of the present invention will be described below in detail.

Polyalkylene terephthalate constituting polyalkylene terephthalate staple fibers of the present invention comprises alkylene glycol and terephthalic acid as main constituent components. The main constituent component means that a repeating unit of polyalkylene terephthalate is 80 mol % or more of the total. As alkylene glycol, linear alkylene glycols having 2 to 10 carbon atoms can be cited or preferably a linear alkylene glycol having 2 to 6 carbon atoms. Specifically, ethylene glycol, trimethylene glycol, tetramethylene glycol, hexamethylene glycol, octamethylene glycol or decamethylene glycol can be cited. Moreover, other monomer components can be copolymerized as long as physical characteristics of polyalkylene terephthalate are not lost, but they are preferably copolymerized so that the repeating unit of polyalkylene terephthalate becomes 80 mol % or more. Acid components capable of copolymerization include aromatic dicarboxylic acid other than terephthalic acid, aliphatic dicarboxylic acid, alicyclic dicarboxylic acid, hydroxy dicarboxylic acid and the like. Specifically, as the aromatic dicarboxylic acid other than terephthalic acid, dicarboxylic acids including aromatic group such as phthalic acid, isophthalic acid, 4,4'-diphenyl dicarboxylic acid, diphenyl ether dicarboxylic acid, diphenyl sulfonic acid, diphenoxy ethane dicarboxylic acid, 3,5-dicarboxy benzene sulfonate (5-sulfoisophthalate), benzophenone dicarboxylic acid and the like can be cited. As the aliphatic dicarboxylic acid, oxalic acid, succinic acid, adipic acid, suberic acid, sebacic acid, dodecanedioic acid and the like can be cited. As alicyclic dicarboxylic acid, cyclopropane dicarboxylic acid, cyclobutane dicarboxylic acid, hexahydroterephthalic acid, cyclohexane dicarboxylic acid, dimer dicarboxylic acid and the like can be cited. Here, dimer dicarboxylic acid indicates a collective name of dicarboxylic acid obtained by dimerizing unsaturated fatty acids such as oleic acid, linoleic acid, α-linoleic acid, γ-linoleic acid, arachidonic acid and the like or compounds obtained by hydrogen reduction of unsaturated bond of remaining carbon: carbon of dimerized dicarboxylic acid. When these dicarboxylic acids are copolymerized, not limited to dicarboxylic acid but a form of dicarboxylic diester compound obtained by subjecting 1 molecule of these dicarboxylic acids to reaction with 2 molecules of alcohol having a hydrocarbon group with 1 to 6 carbon atoms and the like may be used. Moreover, as hydroxycarboxylic acid, glycolic acid, hydroxybutyric acid, hydroxyvaleric acid, hydroxycaproic acid, hydroxypentanoic acid, hydroxyheptanoic acid, hydroxyoctanoic acid and the like can be cited. Moreover, as alcohol component other than the above-described alkylene glycol capable of copolymerization, dihydroxy compounds such as diethylene glycol, triethylene glycol, tetraethylene glycol, 1,2-propanediol, 1,3-butanediol, 1,4-hexanediol, 2-ethyl-1,6-hexanediol, 1,4-dihydroxycyclohexane, 1,4-cyclohexanedimethanol, 2,2-(p-β-hydroxyethoxyphenyl)propane, 2,2-(p-β-hydroxyethoxyethoxyphenyl)propane, polyalkylene glycol and the like can be cited. Other than the above, dihydroxy compound in which 1 to 8 molecules of ethylene oxide are added to phenolic hydroxyl group of bisphenol A can be also used, and moreover, compound having three or more ester-forming functional groups such as glycerin, pentaerythritol, trimethylolpropane, trimesic acid, trimellitic acid and the like can be also used within a range in which a copolymer is substantially linear.

As polyalkylene terephthalate constituting the staple fibers of the present invention, it is necessary to contain 10.0% or more of biomass-derived carbon by radioactive carbon (carbon 14) measurement in all the carbons in the polymer. Moreover, the upper limit of this numerical value range is 100%, but at present, due to restriction in manufacturing, that is, since an industrial method using terephthalic acid made of biomass-derived carbon for the terephthalic acid portion has not been sufficiently established, 25.0% or less is preferable, 24.0% or less is more preferable and 23.4% or less is still more preferable. If the technology progresses in the future, this numerical value would exceed 25.0%, and 100% polyalkylene terephthalate could be manufactured. Here, in specifying the content of a biomass-derived component in the present invention, the meaning of making radioactive carbon (carbon 14) measurement will be described below.

In the upper atmospheric layer, a reaction in which cosmic rays (neutron) collide with nitrogen atoms and generate carbon 14 atoms occurs continuously, and since the generated carbon 14 atoms circulate the entire atmosphere, it is indicated in measurement that carbon dioxide in the atmosphere contains a certain ratio [107 pMC (percent modern carbon) as an average value] of carbon 14. On the other hand, since the carbon 14 atoms contained under the ground is isolated from the above-described circulation, only a reaction of returning to a nitrogen atom in a half-life of 5,370 years while releasing radiation occurs, and the carbon 14 atoms scarcely remain in a fossil material such as current petroleum. Therefore, by measuring concentration of carbon 14 in a sample as a target and by calculating backward the content [107 pMC] of carbon 14 in the atmosphere as an index, the ratio of the biomass-derived carbon in the carbon contained in the sample can be acquired. As its specific measuring method, a method using an accelerator mass spectrometer (AMS) is generally used as discussed below.

Moreover, in the measurement of radioactive carbon (carbon 14), the content of a biomass-derived component can be also analyzed with respect to recycled polyalkylene terephthalate obtained by material recycling, chemical recycling and the like, and thus, this is an effective method also in promoting cyclic use of the biomass-derived component for the purpose of recycling. Therefore, as polyalkylene terephthalate of the present invention, not only polyalkylene terephthalate newly obtained by copolymerizing a biomass-derived component material but also polyalkylene terephthalate obtained by material recycling or chemical recycling using a biomass-derived polyalkylene terephthalate as a material is included.

As polyalkylene terephthalate of the present invention, as described above, alkylene terephthalate is a major repeating unit, but if being formed only of ethylene terephthalate, for example, the carbon atom constituting the polymer has 8 atoms of terephthalic acid monomer and 2 atoms of ethylene glycol monomer, and terephthalic acid and ethylene glycol react at a molar ratio of 1:1.

Moreover, if a monomer component of another alkylene glycol is copolymerized, or if for example, 20 mol % of a diol component is biomass-derived 1,3-propanediol and the remaining diol component is biomass-derived ethylene glycol, the carbon ratio becomes terephthalic acid:ethylene glycol:1,3-propanediol=8:1.6:0.6, and the content of the biomass-derived carbon is 21.6%. If the above composition is used as it is as the diol component and oxalic acid having the smallest number of carbon atoms as an acid component at 20 mol % is copolymerized, the carbon ratio is terephthalic acid:oxalic acid:ethylene glycol:1,3-propanediol=6.4:0.8:1.6:0.6, and the content of the biomass-derived carbon is 23.4%. These cases are shown as an example for calculating the ratio of biomass-derived carbon by radioactive carbon (carbon 14) measurement described in claims and do not mean that the ratio of biomass-derived carbon by the radioactive carbon (carbon 14) measurement in polyalkylene terephthalate or polyalkylene naphthalate constituting staple fibers or a wet-laid nonwoven fabric of the present invention is limited to these numerical values.

Since the staple fibers obtained by using polyalkylene terephthalate or polyalkylene naphthalate manufactured from a material containing the biomass-derived carbon by the radioactive carbon (carbon 14) measurement as above use a plant-derived material, an environmental burden can be reduced as compared with manufacture of the same kind of polyester using a conventional petroleum-derived material. That is, petroleum-derived plastics are not degraded easily but accumulated in the environment if being discarded in the environment. Moreover, a large quantity of carbon dioxide is emitted when plastics are burned, which accelerates global warming. In recent years, measures against serious environmental problems such as a decrease in fossil fuels and an increase in carbon dioxide in the atmosphere have become necessary. On the other hand, plants absorb carbon dioxide in the air during growth and fixes carbon to themselves by photosynthesis. Therefore, carbon dioxide generated when plastic manufactured from the plants as a material is used and burned after the use can be considered to be in the same quantity as that of the carbon dioxide originally absorbed by the plants. That is, even burning of these plastics merely leads to a so-called carbon neutral state and carbon dioxide on the earth is not increased, thereby reducing the environmental burden.

Polyalkylene naphthalate constituting the polyalkylene naphthalate staple fibers of the present invention has alkylene glycol and naphthalene dicarboxylic acid as main constituent components. The main constituent component means that a repeating unit of polyalkylene naphthalate is 80 mol % or more of the total. The polyalkylene naphthalate preferably contains an ethylene naphthalate unit. The ethylene naphthalate preferably contains an ethylene-2,6-naphthalate unit and the ethylene-2,6-naphthalate unit is preferably contained in 90 mol % or more per repeating unit constituting polyalkylene naphthalate, and the staple fibers may be formed of a polyester polymer containing an appropriate third component at a ratio less than the remaining 10 mol %. As alkylene glycol constituting polyalkylene naphthalate other than the ethylene naphthalate unit, linear alkylene glycol having 2 to 10 carbon atoms or preferably linear alkylene glycol having 2 to 6 carbon atoms can be cited. Specifically, ethylene glycol, trimethylene glycol, tetramethylene glycol, hexamethylene glycol, octamethylene glycol or decamethylene glycol can be cited. As naphthalene dicarboxylic acid, 2,6-naphthalenedicarboxylic acid, 2,7-naphthalenedicarboxylic acid, 1,5-naphthalenedicarboxylic acid or 1,6-naphthalenedicarboxylic acid can be cited. As the component other than these alkylene glycol and naphthalenedicarboxylic acid, that is, as the third component, a compound having two ester-forming functional groups per molecule or as aliphatic dicarboxylic acid, for example, oxalic acid, succinic acid, adipic acid, suberic acid, sebacic acid, dodecanedioic acid and the like can be cited. As alicyclic dicarboxylic acid, cyclopropane dicarboxylic acid, cyclobutane dicarboxylic acid, hexahydroterephthalic acid, cyclohexanedicarboxylic acid or dimer dicarboxylic acid can be cited. More detailed description of the dimer dicarboxylic acids cited above are as described above. As aromatic dicarboxylic acid other than naphthalenedicarboxylic acid, phthalic acid, isophthalic acid, or dicarboxylic acids including aromatic group such as 4,4'-diphenyl dicarboxylic acid, diphenyl ether dicarboxylic acid, diphenyl sulfonic acid, diphenoxy ethane dicarboxylic acid, 3,5-dicarboxy benzene sulfonate (5-sulfoisophthalate), benzophenone dicarboxylic acid and the like can be cited. When these dicarboxylic acids are copolymerized, not limited to dicarboxylic acid but a form of dicarboxylic diester compound obtained by subjecting 1 molecule of these dicarboxylic acids to reaction with 2 molecules of alcohol having a hydrocarbon group with 1 to 6 carbon atoms may be used. Moreover, as hydroxycarboxylic acid, hydroxycarboxylic acid containing an aliphatic group or an aromatic group such as glycolic acid, hydroxybutyric acid, hydroxyvaleric acid, hydroxycaproic acid, hydroxypentanoic acid, hydroxyheptanoic acid, hydroxyoctanoic acid, p-hydroxybenzoic acid, p-hydroxyethoxybenzoic acid and the like can be cited. Moreover, as alcoholic component other than the above-described alkylene glycol, dihydroxy compounds such as 1,2-propylene glycol, diethylene glycol, neopentylene glycol, p-xylene glycol, 1,4-cyclohexanedimethanol, p,p'-bis(hydroxyethoxy)diphenyl sulfone, 1,4-bis(β-hydroxyethoxy)benzene, 2,2-bis(p-β-hydroxyethoxyphenyl)propane, 2,2-bis(p-β-hydroxyethoxyethoxyphenyl)propane, polyalkylene glycol and the like can be cited. Other than the above, dihydroxy compound in which 1 to 8 molecules of ethylene oxide are added to phenolic hydroxyl group of bisphenol A can be also used, and moreover, compound having three or more ester-forming functional groups such as glycerin, pentaerythritol, trimethylolpropane, trimesic acid, trimellitic acid and the like can be also used within a range in which a copolymer is substantially linear.

As polyalkylene naphthalate of the present invention, it is necessary to contain 10.0% or more of biomass-derived carbon by radioactive carbon (carbon 14) measurement in all the carbons in the polymer. Moreover, the upper limit is preferably 25.0% or less, more preferably 24.0% or less and still more preferably 23.4% or less. If the technology progresses in the future, this numerical value would exceed 25.0%, and 100% polyalkylene naphthalate could be manufactured.

As polyalkylene naphthalate of the present invention, as described above, alkylene naphthalate is a major repeating unit, but if being formed only of ethylene terephthalate, the carbon atom constituting the polymer has 12 atoms of ethylene-2,6-naphthalate monomer and 2 atoms of ethylene glycol monomer, and ethylene-2,6-naphthalate and ethylene glycol react at a molar ratio of 1:1.

The above-described polyalkylene terephthalate and polyalkylene naphthalate may contain additive agent, fluorescence brightening agent, stabilizing agent, flame retardant, flame retardant auxiliary agent, ultraviolet absorbing agent, antioxidant agent or various pigments for coloring within a range in which the effects of the present invention are not lost.

In the wet-laid nonwoven fabric of the present invention, the polyalkylene terephthalate fully oriented staple fibers or polyalkylene naphthalate fully oriented staple fibers are preferably fully oriented staple fibers spun and drawn by an ordinary method by using polyalkylene terephthalate or polyalkylene naphthalate. A draw ratio is preferably 1.2 to 30.0 times and more preferably 1.3 to 25.0 times. On the other hand, the polyalkylene terephthalate low oriented staple fibers or polyalkylene naphthalate low oriented staple fibers are those with fiber elongation degree of 100 to 500% in the spun and fully oriented staple fibers by an ordinary method using polyalkylene terephthalate or polyalkylene naphthalate. Particularly 150 to 300% is preferable.

On the other hand, the fully oriented staple fibers and low oriented staple fibers are preferably staple fibers made of a single type of polyester component, but also may be core-in-sheath type composite fibers in which a polymer component (amorphous copolymer polyalkylene terephthalate, for example) which is melted by heat treatment at 80 to 170° C. applied after web forming and exerts an adhesion effect is disposed in a sheath part and other polymers (ordinary polyalkylene terephthalate such as polyethylene terephthalate, polytrimethylene terephthalate, polybutylene terephthalate and the like, for example) having a melting point higher than these polymers by 20° C. or more are disposed in a core part. The polyalkylene terephthalate low oriented staple fibers and polyalkylene naphthalate low oriented staple fibers may be known composite fibers such as concentric core-and-sheath composite fibers, eccentric core-and-sheath composite fibers, side-by-side composite fibers and the like, wherein a binder component (low-melting-point component) forms the whole of or a part of the surface of the single fiber.

Here, the above-described amorphous copolymer polyalkylene terephthalate preferably has 50 mol % or more of ethylene terephthalate unit with respect to all the repeating units. Copolymer components other than the ethylene terephthalate unit include dicarboxylic acid components such as isophthalic acid, 2,6-naphthalenedicarboxylic acid, 2,7-naphthalenedicarboxylic acid, sodium 5-sulfoisophthalate, adipic acid, sebacic acid, azelaic acid, dodecanedicarboxylic acid, 1,4-cyclohexanedicarboxylic acid and the like and diol components such as 1,2-propanediol, 1,3-propanediol, 1,4-butanediol, 1,5-pentanediol, 1,6-hexanediol, diethylene glycol, 1,4-cyclohexanediol, 1,4-cyclohexanedimethanol and the like. The copolymer polyalkylene terephthalate is obtained as a random copolymer or a block copolymer obtained from these materials. Particularly, terephthalic acid, isophthalic acid, ethylene glycol and diethylene glycol which have been widely used are preferably used as a main component in terms of costs. Such copolymer polyalkylene terephthalate has a glass transition point within a range from 50 to 100° C. and may not indicate clear crystalline melting point in some cases.

Here, it is important that the polyalkylene terephthalate staple fibers and polyalkylene naphthalate staple fibers have single fiber fineness of 0.0001 to 7.0 decitex or preferably 0.001 to 5.0 decitex. More preferably it can be selected from 0.01 to 3.0 decitex, 0.1 to 2.5 decitex or 0.5 to 2.0 decitex. If the single fiber fineness is smaller than 0.0001 decitex, it is not only that rigidity as a nonwoven fabric becomes small but also tensile strength as fibers might deteriorate, and this is not favorable. On the contrary, if the single fiber fineness is larger than 7.0 decitex, web uniformity when being formed into a nonwoven fabric might deteriorate, and this is not favorable. Moreover, in the polyalkylene terephthalate staple fibers and polyalkylene naphthalate staple fibers of the present invention, the cross-sectional shape of the single fiber is particularly preferably circular, but modified cross-sectional shapes (hollow, polygon of a triangle or more, flat, flat with a twist, multifoli and the like, for example) may be used.

In the polyalkylene terephthalate staple fibers and polyalkylene naphthalate staple fibers of the present invention, the fiber lengths of the both are preferably within a range of 0.1 to 20 mm. Preferably it can be selected from 0.5 to 15 mm, more preferably from 1.0 to 12 mm, 2.0 to 10 mm or 3.0 to 8.0 mm. If the staple fiber length is smaller than 0.1 mm, the aspect ratio becomes small, and it is likely that the staple fibers can easily drop during a web forming process. Moreover, if the staple fiber length is smaller than 0.1 mm, productivity of the staple fiber manufacturing process needs to be lowered in order to cut a uniform fiber length in some cases. On the contrary, if the staple fiber length is larger than 20 mm, it may become difficult for the staple fibers to be distributed in a medium during the web forming process. In the polyalkylene terephthalate staple fibers and polyalkylene naphthalate staple fibers of the present invention, crimping as described in Japanese Unexamined Patent Application Publication No. 2001-268691 may be applied, but in order to increase water dispersion performance and to have better web uniformity, these polyalkylene terephthalate staple fibers preferably have no crimp (no crimping). Moreover, the polyalkylene terephthalate staple fibers and polyalkylene naphthalate staple fibers of the present invention can be suitably used for a wet-laid nonwoven fabric whether they are fully oriented staple fibers or low oriented staple fibers, as will be described later.

In the polyalkylene terephthalate staple fibers and polyalkylene naphthalate staple fibers of the present invention, dry heat shrinkage at 180° C. is preferably 0.5 to 15.0%. It is more preferably 1.0 to 10.0% and still more preferably 2.0 to 8.0%. It can be set as appropriate depending on the draw ratio during drawing processing or on the conditions of relaxation heat treatment performed after that. On the other hand, in the case of the polyalkylene terephthalate low oriented staple fibers and polyalkylene naphthalate low oriented staple fibers, manufacturing is possible so that the dry heat shrinkage at 180° C. indicates a negative value by selecting the relaxation heat treatment conditions and the like, but in the case of the manufacturing under the conditions disclosed in the example, fibers are broken due to melting under the temperature of 180° C. and the dry heat shrinkage at 180° C. cannot be measured in some cases.

Moreover, in order to fully exemplify the nature of the staple fibers of the present invention, a wet-laid nonwoven fabric (α) which contains 15 mass % or more and 100 mass % or less of the polyalkylene terephthalate staple fibers or polyalkylene naphthalate staple fibers for which the biomass-derived carbon ratio, fineness, and fiber length are prescribed is preferably employed. In this nonwoven fabric, any one of 20 mass % or more, 30 mass % or more or 40 mass % or more can be more preferably selected. Subsequently, a wet-laid nonwoven fabric containing 15 mass % or more of the polyalkylene terephthalate fully oriented staple fibers or polyalkylene naphthalate fully oriented staple fibers can be preferably employed. In this nonwoven fabric, any one of 20 mass % or more, 30 mass % or more or 40 mass % or more can be more preferably selected. Subsequently, a wet-laid nonwoven fabric containing 15 mass % or more of the polyalkylene terephthalate low oriented staple fibers or polyalkylene naphthalate low oriented staple fibers can be preferably employed. In this nonwoven fabric, any one of 20 mass % or more, 30 mass % or more or 40 mass % or more can be more preferably selected. By properly selecting a mixing ratio of the fully oriented staple fibers and the low oriented staple fibers, a nonwoven fabric with a good balance among tensile strength, tear strength and web uniformity can be manufactured. More preferably, a wet-laid nonwoven fabric (β) composed of one type or two types or more of only polyalkylene terephthalate staple fibers or one type or two types or more of polyalkylene naphthalate staple fibers is employed. In this wet-laid nonwoven fabric, too, 15 mass % or more and 100 mass % or less of the polyalkylene terephthalate low oriented staple fibers or polyalkylene naphthalate low oriented staple fibers are preferably contained. Therefore, the former wet-laid nonwoven fabric (α) is likely to become a nonwoven fabric containing polyolefin fibers, pulps and the like, for example, while the latter wet-laid nonwoven fabric (β) becomes a nonwoven fabric made of 100% polyalkylene terephthalate staple fibers and/or polyalkylene naphthalate staple fibers.

In the nonwoven fabric of the present invention, regarding the weight ratio A/B between the polyalkylene terephthalate fully oriented staple fibers and the polyalkylene terephthalate low oriented staple fibers or between the polyalkylene naphthalate fully oriented staple fibers and the polyalkylene naphthalate low oriented staple fibers, a wet-laid nonwoven fabric having a weight ratio within a range from 15/85 to 85/15, preferably from 20/80 to 80/20 or from 30/70 to 70/30 or more preferably from 40/60 to 60/40 is preferable. If the weight ratio of the low oriented staple fibers is smaller than the stated range, form stability of the nonwoven fabric is lost and scuffing or the like may easily occur, which is not preferable. On the contrary, if the weight ratio of the low oriented staple fibers is larger than the stated range, the completed wet-laid nonwoven fabric is too compact and resembles a film, and tensile strength or tear strength as a wet-laid nonwoven fabric deteriorates, which is not preferable.

In the wet-laid nonwoven fabric composed only of the polyalkylene terephthalate fully oriented staple fibers and the polyalkylene terephthalate low oriented staple fibers or only of the polyalkylene naphthalate fully oriented staple fibers and the polyalkylene naphthalate low oriented staple fibers, aromatic polyester fibers (for example polycyclohexane terephthalate fibers, and poly(cyclohexane dimethylene) terephthalate fibers), wooden pulp (pulp mainly using softwood, also referred to as NBKP in some cases), rayon fiber or the like may be contained if it is 10 mass % or less, preferably 5 mass % or less or more preferably 0.1 to 4.0 mass % to the total weight of the nonwoven fabric. Moreover, the weight per unit area of the wet-laid nonwoven fabric in the present invention may be selected in accordance with the purpose and is not particularly limited but it is usually within a range of 10 to 500 g/m$^2$, preferably 20 to 300 g/m$^2$ or more, more preferably 30 to 200 g/m$^2$, further more preferably 50 to 100 g/m$^2$.

The staple fibers of the present invention described above can be manufactured by the following method, for example. Polyalkylene terephthalate or polyalkylene naphthalate to which drying treatment is sufficiently applied is discharged from a spinneret using a known spinning facility and taken up at a speed of 100 to 2000 m/min while being cooled so as to obtain an low oriented yarn. Subsequently, drawing treatment is applied to the obtained low oriented yarns in hot water at 70 to 100° C. or in a steam at 100 to 125° C. If it is used as a binder fiber for a nonwoven fabric as will be described later, the above-described drawing treatment does not have to be applied in some cases. Moreover, after the drawing treatment or in an undrawn state, crimping is applied as necessary, an oil agent according to the application and purpose is applied and drying and relaxation thermal treatment are performed and then, it is cut to a predetermined fiber length so that the staple fibers of the present invention can be obtained.

The oil agent used in the manufacture of the staple fibers may contain silicone compounds of an amount not obstructing achievement of the object of the present invention and a type not obstructing achievement of the object of the present invention. Since the staple fibers are dispersed in water during manufacturing of the wet-laid nonwoven fabric, use of a copolymer of polyalkylene terephthalate and polyethylene glycol having hydrophilic property and a good affinity with polyalkylene terephthalate or polyalkylene naphthalate can be preferably employed as an oil agent. This copolymer is also referred to as polyether/ester copolymer. In this copolymer, in order to have a good balance between hydrophilic property and affinity with polyester, a polyether/ester copolymer satisfying at least any of the following conditions is preferably used. A number average molecular weight of polyethylene glycol to be used is preferably 1000 to 5000, or more preferably 1500 to 4000. Polyethylene glycol preferably in 50 to 80 mass %, or more preferably 60 to 75 mass % is used with respect to the total weight of the polyether/ester copolymer. This polyethylene glycol constitutes a polyether portion. The remaining portion of 20 to 50 mass % or preferably 25 to 40 mass % constitutes a polyester portion. The dicarboxylic acid component constituting the polyester portion is preferably copolymerized at 5 to 30 mol % of isophthalic acid with respect to the total dicarboxylic acid component constituting the polyester portion. As the remaining dicarboxylic acid component, terephthalic acid is preferably used. As the diol component constituting the polyester portion, ethylene glycol is preferably used. This oil agent is preferably allowed to adhere at 0.0005 to 0.01 mass % with respect to the staple fibers. The amount of the oil agent to be adhered to the staple fibers is preferably within a range from 0.0008 to 0.008 mass %, more preferably from 0.001 to 0.005 mass % or most preferably from 0.002 to 0.004 mass %.

Next, a manufacturing method of a wet-laid nonwoven fabric of the present invention will be described. The staple fibers obtained by the above-described operations, that is, the polyalkylene terephthalate fully oriented staple fibers and the polyalkylene terephthalate low oriented staple fibers or the polyalkylene naphthalate fully oriented staple fibers and the polyalkylene naphthalate low oriented staple fibers are subjected to wet-laid web forming and then dried. At this time, drying is performed after the wet-laid web forming by using the fully oriented staple fibers (A) and the low oriented staple fibers (B) so that their weight ratio A/B is preferably within the range of 15/85 to 85/15. At that time, as the wet-laid web forming method, short wire, long wire, cylinder and their combination (multilayer web forming) can be used depending on the shape of a wire part for web forming and the like, and any method can complete wet-laid web forming without a problem. As the drying treatment process, a drum dryer or an air-through dryer is preferably used for applying heat treatment and drying. In more detail, Yankee dryer for bringing fibers in contact with a cylindrical drum, multi-cylinder drum in which a large number of drums are aligned, hot air suction (air-through dryer) by hot air and the like can be used. At that time, a range of 80 to 150° C. is preferable as a drying treatment temperature.

After the drying treatment process, calendering (nonwoven fabric is passed through two heating rolls) treatment can be performed in the final stage as necessary. By applying such calendering treatment, at least a part of the low oriented staple fibers is melted and heat adhesion between the staple fibers become firm, and a wet-laid nonwoven fabric having excellent tensile strength can be obtained. In order to improve tensile strength of a nonwoven fabric as above, application of calendering becomes important in some cases. Here, with a calendering machine, a known material (metal, paper, resin and the like) and a known roll (flat, emboss and the like) can be used for calendering. At that time, a surface temperature of the calender roll is preferably within a range of 100 to 200° C. and a line pressure is preferably within a range of 100 to 300 kgf/cm (980 to 2940 N/cm).

In the present invention, manufacturing of a wet-laid nonwoven fabric by the following manufacturing method is also possible. That is, a wet-laid nonwoven fabric composed of only the polyalkylene terephthalate low oriented staple fibers, only the polyalkylene terephthalate fully oriented staple fibers, or only the polyalkylene terephthalate fully oriented staple fibers and low oriented staple fibers or a wet-laid nonwoven fabric web composed of only the polyalkylene naphthalate low oriented staple fibers, only the polyalkylene naphthalate fully oriented staple fibers or only the polyalkylene naphthalate fully oriented staple fibers and the polyalkylene naphthalate low oriented staple fibers is made once by using a known wet-laid web forming method. Then, if low oriented staple fibers are contained in the staple fibers constituting the wet-laid nonwoven fabric web, the low oriented staple fibers are melted so as to bond the staple fibers together and to make a sheet. Moreover, the sheet is laminated in a single layer or two layers or more, or if low oriented staple fibers are not contained in the wet-laid nonwoven web, the wet-laid nonwoven web is laminated in a single layer or two layers or more and the staple fibers are three dimensionally entangled by a high-pressure water jet so that a wet-laid nonwoven fabric can be made. At that time, a nozzle hole diameter for injecting the water flow to the sheet or the wet-laid nonwoven fabric web is preferably within a range of 10 to 500 μm and a nozzle hole interval is preferably from 500 μm to 10 mm in order to entangle them firmly and keep web uniformity favorable. Moreover, the water pressure is preferably used within a range of 10 to 250 kg/cm$^2$. A machining speed is preferably used within a range of 15 to 200 m/min.

The wet-laid nonwoven fabric obtained by the present invention is excellent in adhesive strength and heat resistance at a reduced environmental burden by using the polyalkylene terephthalate or polyalkylene naphthalate staple fibers containing biomass-derived carbon.

EXAMPLE

Subsequently, examples and comparative examples of the present invention will be described in detail, but the contents of the present invention are not limited by them. Each measurement item in examples was measured by the following methods.

(a) Glass Transition Temperature (Tg)

Measured under the condition of a temperature rising speed of 20° C./min in accordance with differential scanning calorimetry (DSC) described in JIS (representing Japanese Industrial Standard. The same applies to the following) K7121.

(b) Intrinsic Viscosity (η)

Determined from a value obtained by measuring the viscosity of a diluted solution in which a polyester sample is dissolved in orthochlorophenol at 100° C. for 60 minutes by using Ubbelohde viscometer at 35° C.

(c) Single Fiber Fineness

Measured in accordance with the method described in JIS L 1015:2005 8.5.1A method.

(d) Fiber Length

Measured in accordance with the method described in JIS L 1015:2005 8.4.1C method.

(e) Fiber Strength, Fiber Elongation

Measured in accordance with the method described in JIS L 1015:2005 8.7.1.

(f) Crimping Number, Crimping Rate

Measured in accordance with the method described in JIS L 1015:2005 8.12.

(g) Dry Heat Shrinkage at 180° C.

Measured at 180° C. in accordance with the method described in JIS L1015:2005 8.15b.

(h) Thickness, Weight Per Unit Area (Weight, Mass Per Unit Area) and Density

The thickness of the nonwoven fabric was measured in accordance with the method described in JIS L1913:2010 6.1 and the weight per unit area of the nonwoven fabric was measured by the method described in JIS L1913:2010 6. 2. Moreover, the density of the nonwoven fabric was calculated by dividing the weight per unit area of the nonwoven fabric by the above-described value of the nonwoven fabric thickness.

(i) Wet-Laid Nonwoven Fabric Tensile Strength

Measured based on JIS P8113 (Paper and board—Determination of tensile properties).

(j) Content of Radioactive Carbon (Carbon 14) (Biomass-Derived Carbon Ratio)

A mixed ratio sample of the biomass-derived carbon by measurement of radioactive carbon (carbon 14) was subjected to an accelerator mass spectrometer (AMS) and the content of carbon 14 was measured. Carbon dioxide in the atmosphere contains a certain ratio of carbon 14 (because neutrons collide with nitrogen atoms and generate carbon 14 atoms in the upper atmospheric layer), but fossil materials such as petroleum contain almost no carbon 14 (because carbon 14 changes to nitrogen under the ground in a half-life of 5370 years while releasing radiation). On the other hand, the ratio of carbon 14 in the atmosphere at present is measured to be a specific value [107 pMC (percent modern carbon) as an average value], and it is known that carbon 14 is taken in at this ratio into the present plants performing photosynthesis. Therefore, by measuring the contents of all the carbons and the carbon 14 in the sample, the ratio of the biomass-derived carbon in the carbon contained in the sample can be determined (See the following formula):

Biomass-derived carbon ratio (%)=(amount of biomass-derived carbon in sample/total carbon amount in sample)×100

(k) Web Uniformity

The state of the surface of a finished nonwoven fabric sample was visually checked and 4-grade evaluation was made. Evaluation was designated as 4th-grade, 3rd-grade, 2nd-grade, and 1st-grade in the order of descending quality from the best web uniformity.

In the following Examples/Comparative Examples, polyethylene terephthalate containing 10% or more and 100% or less of biomass-derived carbon is referred to as bio-polyethylene terephthalate or bio-PET, and polyethylene naphthalate containing 10% or more and 100% or less of biomass-derived carbon is referred to as bio-polyethylene naphthalate or bio-PEN. Moreover, known polyethylene terephthalate not containing biomass-derived carbon is referred to as petroleum-derived polyethylene terephthalate or petroleum-derived PET, and known polyethylene naphthalate not containing biomass-derived carbon is referred to as petroleum-derived polyethylene naphthalate or petroleum-derived PEN.

Example 1

(Bio-Polyethylene Terephthalate Fully Oriented Staple Fibers)

After bio-polyethylene terephthalate chips manufactured by Teijin were dried, it was melted at 290° C. and discharged at 180 g/min through a spinneret having 1192 holes and taken in at a speed of 500 m/min so as to obtain low oriented fibers. The low oriented fibers were made to converge into a tow of approximately 140 thousand decitex and then drawn in hot water to 17.7 times so as to obtain fully oriented fibers. Moreover, the fully oriented fibers were made to pass through aqueous emulsion (solid concentration at 3.0%) of a polyether/polyester copolymer having number average molecular weight of approximately 10000 shown below and squeezed so that moisture content in the fully oriented fibers falls to approximately 12%. In this polyether/polyester copolymer, a polyester portion is composed of 80 mol % of terephthalic acid and 20 mol % of isophthalic acid as the dicarboxylic acid component and ethylene glycol as the diol component of the polyester portion. The polyester portion at 30 mass % of the polyether/ester copolymer is composed of this polyethylene terephthalate/isophthalate copolymer, while the remaining 70 mass % of the polyether portion is a copolymer composed of 70 mass % of polyethylene glycol having number average molecular weight of 3000. After that, the fully oriented fibers were cut at a fiber length of 5 mm without drying, drying was applied, and bio-polyethylene terephthalate fully oriented staple fibers (no crimp) having single fiber fineness of 0.60 decitex were obtained.

(Bio-Polyethylene Terephthalate Low Oriented Staple Fibers)

After bio-polyethylene terephthalate chips manufactured by Teijin were dried, it was melted at 290° C. and discharged at 180 g/min through a spinneret having 1192 holes and taken in at a speed of 500 m/min so as to obtain low oriented fibers. The low oriented fibers were made to converge into a tow of approximately 140 thousand decitex. After that, without drawing, the low oriented fibers were made to pass through aqueous emulsion (solid concentration at 3.0%) of a polyether/polyester copolymer having number average molecular weight of approximately 10000 shown below, and squeezed so that moisture content in the fully oriented fibers falls to approximately 12%. The composition of the polyether/polyester copolymer is the same as that of the bio-polyethylene terephthalate fully oriented staple fibers. After that, the low oriented fibers were cut at a fiber length of 5 mm without drying, drying was applied, and bio-polyethylene terephthalate low oriented staple fibers (no crimp) having single fiber fineness of 1.2 decitex were obtained.

(Wet-Laid Web Forming Processing, Drying Treatment and Calendering Treatment)

The bio-polyethylene terephthalate fully oriented staple fibers and the bio-polyethylene terephthalate low oriented staple fibers were mixed and agitated at the weight ratio of 70/30 using water as a medium and then made into paper using a manual paper machine (by Kumagai Riki Kogyo Co., Ltd., model: No. 2555, standard square sheet machine, the same applies to the following). Subsequently, the papered fibers were subjected to drying treatment at 120° C. for 2 minutes by using a rotary dryer (by Kumagai Riki Kogyo Co., Ltd., model: 2575-II rotary dryer (high temperature type)). After that, calendering (180° C.×200 kg/cm (1960 N/cm)) was applied by using a device composed of metal roll/metal roll, and a wet-laid nonwoven fabric was obtained. The physical characteristics of the fully oriented staple fibers, the low oriented staple fibers and the wet-laid nonwoven fabric are shown in Table 1.

Example 2

A wet-laid nonwoven fabric was obtained by the method similar to that of Example 1 except that the mixing ratio between the fully oriented staple fibers and the low oriented staple fibers was changed from that given in Example 1. The physical characteristics of the fully oriented staple fibers, the low oriented staple fibers and the wet-laid nonwoven fabric are shown in Table 1.

Example 3

Bio-Polyethylene Naphthalate Fully Oriented Staple Fibers

After bio-polyethylene naphthalate chips manufactured by Teijin were dried, it was melted at 320° C. and discharged at 310 g/min through a spinneret having 1305 holes and taken in at a speed of 1350 m/min so as to obtain low oriented fibers. The low oriented fibers were made to converge into a tow of approximately 130 thousand decitex and then drawn in hot water to 1.85 times so as to obtain fully oriented fibers. Moreover, the fully oriented fibers were made to pass through the same aqueous emulsion (solid concentration at 3.0%) of a polyether/polyester copolymer as that used in Example 1 and squeezed so that moisture content in the fully oriented fibers falls to approximately 12%. After that, the fully oriented fibers were cut at a fiber length of 5 mm without drying, drying was applied, and bio-polyethylene naphthalate fully oriented staple fibers (no crimp) having single fiber fineness of 0.5 decitex were obtained.

(Bio-Polyethylene Naphthalate Low Oriented Staple Fibers)

After bio-polyethylene naphthalate chips manufactured by Teijin were dried, it was melted at 320° C. and discharged at 290 g/min through a spinneret having 1305 holes and taken in at a speed of 1000 m/min so as to obtain low oriented fibers. The low oriented fibers were made to converge into a tow of approximately 140 thousand decitex. After that, without drawing, the low oriented fibers were made to pass through the same aqueous emulsion (solid concentration at 3.0%) of a polyether/polyester copolymer as that used in Example 1 and squeezed so that moisture content in the low oriented fibers falls to approximately 12%. After that, the low oriented fibers were cut at a fiber length of 5 mm without drying, drying was applied, and bio-polyethylene naphthalate low oriented staple fibers (no crimp) having single fiber fineness of 1.1 decitex were obtained.

(Wet-Laid Web Forming Processing, Drying Treatment and Calendering Treatment)

The bio-polyethylene naphthalate fully oriented staple fibers and the bio-polyethylene naphthalate low oriented staple fibers were mixed and agitated at the weight ratio of 70/30 using water as a medium and then made into paper using a manual papering machine (by Kumagai Riki Kogyo Co., Ltd., model: No. 2555, standard square sheet machine, the same applies to the following). Subsequently, the papered fibers were subjected to drying treatment at 145° C. for 2 minutes by using a rotary dryer (by Kumagai Riki Kogyo Co., Ltd., model: 2575-IL rotary dryer (high temperature type)). After that, calendering (180° C.×200 kg/cm (1960 N/cm)) was applied by using metal roll/metal roll, and a wet-laid nonwoven fabric was obtained. The physical characteristics of the fully oriented staple fibers, the low oriented staple fibers and the wet-laid nonwoven fabric are shown in Table 1.

Example 4

A wet-laid nonwoven fabric was obtained by the method similar to that of Example 3 except that the ratio between the fully oriented staple fibers and the low oriented staple fibers was changed from that given in Example 3. The physical characteristics of the fully oriented staple fibers, the low oriented staple fibers and the wet-laid nonwoven fabric are shown in Table 1.

TABLE 1

| Item | | Unit | Example 1 | Example 2 | Example 3 | Example 4 |
|---|---|---|---|---|---|---|
| Fully oriented fiber | Polymer type | — | Bio-PET | Bio-PET | Bio-PEN | Bio-PEN |
| | Single fiber fineness | dtex | 0.6 | 0.6 | 0.5 | 0.5 |
| | Fiber length | mm | 5.0 | 5.0 | 5.0 | 5.0 |
| | Fiber strength | cN/dtex | 4.5 | 4.5 | 4.5 | 4.5 |
| | Fiber elongation | % | 50 | 50 | 35.8 | 35.8 |
| | Dry heat shrinkage at 180° C. | % | 5.0 | 5.0 | 5.5 | 5.5 |
| | Biomass-derived carbon ratio | % | 20 | 20 | 10 | 10 |
| Low oriented fiber (binder fibers) | Polymer type | — | Bio-PET | Bio-PET | Bio-PEN | Bio-PEN |
| | Binder fibers (type) | | UDY | UDY | UDY | UDY |
| | Single fiber fineness | dtex | 1.2 | 1.2 | 1.1 | 1.1 |
| | Fiber length | mm | 5.0 | 5.0 | 5.0 | 5.0 |
| | Fiber strength | cN/dtex | 0.91 | 0.91 | 1.94 | 1.94 |
| | Fiber elongation | % | 136.7 | 136.7 | 152.6 | 152.6 |
| | Dry heat shrinkage at 180° C. | % | Measurement impossible due to fusing | Measurement impossible due to fusing | Measurement impossible due to fusing | Measurement impossible due to fusing |
| | Ratio of biomass-derived carbon content | % | 20 | 20 | 10 | 10 |
| | Other fibers | — | — | — | — | — |
| Raw cotton composition (fully oriented fiber/low oriented fiber/others) | | mass % | 70/30/0 | 50/50/0 | 70/30/0 | 50/50/0 |
| Wet-laid nonwoven fabric | Manufacturing method | — | Wet-laid web forming method | Wet-laid web forming method | Wet-laid web forming method | Wet-laid web forming method |
| | Rotary dryer treatment conditions | — | 120° C. × 2 min | 120° C. × 2 min | 145° C. × 2 min | 145° C. × 2 min |
| | Air-through dryer treatment conditions | — | — | — | — | — |
| | Calendering treatment conditions (metal roll/metal roll) | — | 180° C. × 200 kg/cm | 180° C. × 200 kg/cm | 180° C. × 200 kg/cm | 180° C. × 200 kg/cm |
| | Weight per unit area | $g/m^2$ | 70 | 71 | 69 | 70 |
| | Thickness | mm | 0.11 | 0.10 | 0.08 | 0.09 |
| | Density | $g/cm^3$ | 0.64 | 0.71 | 0.86 | 0.78 |
| | Tensile strength | N/15 mm | 21 | 32 | 32 | 41 |
| | Web uniformity | class | 4 | 4 | 4 | 4 |
| | Ratio of biomass-derived carbon content | % | 20 | 20 | 10 | 10 |
| | Results | | Productivity of manufacturing process was favorable, web uniformity was excellent and nonwoven fabrics with reduced environmental burden were obtained. | Productivity of manufacturing process was favorable, web uniformity was excellent and nonwoven fabrics with reduced environmental burden were obtained. | Productivity of manufacturing process was favorable, web uniformity was excellent and nonwoven fabrics with reduced environmental burden were obtained. | Productivity of manufacturing process was favorable, web uniformity was excellent and nonwoven fabrics with reduced environmental burden were obtained. |

UDY: Undrawing Yarn

Example 5

The fully oriented staple fibers described in Example 1, low oriented composite staple fibers shown below, and wooden pulp (NBKP) were mixed and agitated at the mass % ratio of 50/30/20 using water as a medium. Using the mixture, a wet-laid nonwoven fabric was obtained by the method similar to that of Example 1 except that calendering was not performed. The physical characteristics of the fully oriented staple fibers, the low oriented composite staple fibers, and the wet-laid nonwoven fabric are shown in Table 2.

(Manufacturing of Low Oriented Composite Staple Fibers)

A pellet of amorphous copolymer polyethylene terephthalate obtained by copolymerizing at a fraction of 40 mol % of isophthalic acid having intrinsic viscosity [η] of 0.55 dL/g and Tg of 65° C. measured after vacuum drying at 50° C. for 24 hours was melted in a biaxial extruder, and melted polyester at 250° C. was obtained. On the other hand, a pellet of polyethylene terephthalate having intrinsic viscosity [η] of 0.61 dL/g measured after vacuum drying at 120° C. for 16 hours was melted in a biaxial extruder, and melted polyester at 280° C. was obtained. The two types of melted polyester, the former of which was used as a sheath component A and the latter as a core component B, were melted and discharged in a composite manner through a known core-and-sheath composite spinneret having 1032 pieces of circular-hole capillaries, each having a diameter of 0.3 mm so that the cross-sectional area ratio becomes A:B=50:50. At this time, the composite spinneret temperature was 285° C. and the discharged amount was 870 g/min. Moreover, the melted and discharged polyester was cooled by cooling air at 30° C. and reeled at 1150 m/min so as to obtain an low oriented yarn. Subsequently, it was cut at a fiber length of 5.0 mm so as to obtain low oriented composite staple fibers having single fiber fineness of 1.1 decitex.

Example 6

A wet-laid nonwoven fabric was obtained by the method similar to that of Example 5 except that the ratio between the fully oriented staple fibers, the low oriented composite staple fibers, and NBKP was changed from that given in Example 5. The physical characteristics of the fully oriented staple fibers, the low oriented composite staple fibers, and the wet-laid nonwoven fabric are shown in Table 2.

Example 7

The manufacturing conditions of the fully oriented staple fibers described in Example 1 were changed, and fully oriented staple fibers having single fiber fineness of 0.17 decitex were obtained. A web was manufactured by an ordinary wet-laid spun lace method using only the fully oriented staple fibers, drying at 130° C. for 2 minutes was applied by an air-through dryer, and a wet-laid nonwoven fabric was obtained. In the spun lace method, 3 pieces of nozzle head were used, and the staple fibers in the web were three dimensionally entangled by using a columnar water jet. The conditions of the three-head nozzle composed of first to third head are as follows:

A) First Head:
Water flow direction: downward direction
Nozzle alignment form: 2-row zigzagged alignment
Nozzle hole diameter: 120 μm
Nozzle hole interval: 1 mm
Nozzle row interval: 1 mm
Water flow pressure: 50 kg/cm$^2$ B) Second Head:
Water flow direction: upward direction
Nozzle alignment form: 2-row zigzagged alignment
Nozzle hole diameter: 120 μm
Nozzle hole interval: 1 mm
Nozzle row interval: 1 mm
Water flow pressure: 100 kg/cm$^2$ C) Third Head:
Water flow direction: from downward direction
Nozzle alignment form: 2-row zigzagged alignment
Nozzle hole diameter: 80 μm
Nozzle hole interval: 1 mm
Nozzle row interval: 1 mm
Water flow pressure: 100 kg/cm$^2$ The physical characteristics of those fully oriented staple fibers and the wet-laid nonwoven fabric are shown in Table 2.

Example 8

A wet-laid nonwoven fabric was obtained by the method similar to that of Example 7 except that the composition ratio of raw cotton in the description of Example 7 was changed from 100 mass % bio-polyethylene terephthalate having single fiber fineness of 0.17 decitex to 50 mass % bio-polyethylene terephthalate having single fiber fineness of 0.17 decitex, 10 mass % low oriented composite staple fibers used in Example 5, and 40 mass % rayon staple fibers having single fiber fineness of 0.7 decitex and fiber length of 8 mm. The physical characteristics of the fully oriented staple fibers, the low oriented composite staple fibers, and the wet-laid nonwoven fabric are shown in Table 2.

TABLE 2

| Item | | Unit | Example 5 | Example 6 | Example 7 | Example 8 |
|---|---|---|---|---|---|---|
| Fully oriented fiber | Polymer type | — | Bio-PET | Bio-PET | Bio-PET | Bio-PET |
| | Single fiber fineness | dtex | 0.6 | 0.6 | 0.17 | 0.17 |
| | Fiber length | mm | 5.0 | 5.0 | 5.0 | 5.0 |
| | Fiber strength | cN/dtex | 4.5 | 4.5 | 2.51 | 2.51 |
| | Fiber elongation | % | 50 | 50 | 31.9 | 31.9 |
| | Dry heat shrinkage at 180° C. | % | 5.0 | 5.0 | 3.2 | 3.2 |
| | Ratio of biomass-derived carbon content | % | 20 | 20 | 20 | 20 |
| Low oriented fiber (binder fibers) | Polymer type | — | Bio-PET | Bio-PET | None | Bio-PET |
| | Binder fibers (type) | | Core-and-sheath composite | Core-and-sheath composite | — | Core-and-sheath composite |
| | Single fiber fineness | dtex | 1.1 | 1.1 | — | 1.1 |
| | Fiber length | mm | 5.0 | 5.0 | — | 5.0 |
| | Fiber strength | cN/dtex | 3.25 | 3.25 | — | 3.25 |
| | Fiber elongation | % | 35.0 | 35.0 | — | 35.0 |
| | Dry heat shrinkage at 180° C. | % | Measurement impossible due to fusing | Measurement impossible due to fusing | — | Measurement impossible due to fusing |
| | Ratio of biomass-derived carbon content | % | 20 | 20 | — | 20 |
| | Other fibers | — | Wooden pulp (NBKP) | Wooden pulp (NBKP) | — | Rayon |
| Raw cotton composition (fully oriented fiber/low oriented fiber/others) | | mass % | 50/30/20 | 20/30/50 | 100/0/0 | 50/10/40 |
| Wet-laid nonwoven fabric | Manufacturing method | — | Wet-laid web forming method | Wet-laid web forming method | Wet-laid spun lace method | Wet-laid spun lace method |
| | Rotary dryer treatment conditions | — | 120° C. × 2 min | 120° C. × 2 min | — | — |
| | Air-through dryer treatment conditions | — | — | — | 130° C. × 2 min | 130° C. × 2 min |
| | Calendering treatment conditions (metal roll/metal roll) | — | — | — | — | — |
| | Weight per unit area | g/m$^2$ | 70 | 69 | 50 | 50 |
| | Thickness | mm | 0.21 | 0.18 | 0.08 | 0.09 |
| | Density | g/cm$^3$ | 0.33 | 0.38 | 0.63 | 0.56 |
| | Tensile strength | N/15 mm | 15 | 18 | 12 | 21 |
| | Web uniformity | class | 4 | 4 | 4 | 4 |
| | Ratio of biomass-derived carbon content | % | 36 | 60 | 20 | 20 |
| | Results | | Bulky pulp blended nonwoven fabric was | Bulky pulp blended nonwoven fabric was | Productivity of manufacturing process was | Productivity of manufacturing process was |

TABLE 2-continued

| Item | Unit | Example 5 | Example 6 | Example 7 | Example 8 |
|---|---|---|---|---|---|
| | | obtained, and those with excellent characteristics required for wiper applications and the like were obtained. At the same time, an environmental burden can be also reduced. | obtained, and those with excellent characteristics required for wiper applications and the like were obtained. At the same time, an environmental burden can be also reduced. | favorable also for a wet-laid spun lace nonwoven fabric made of 100% fully oriented fabrics, and nonwoven fabrics with reduced environmental burden were obtained. | favorable also for a wet-laid spun lace nonwoven fabric made of binder fibers, fully oriented fibers, and other fibers mixed, and nonwoven fabrics with reduced environmental burden were obtained. |

Staple fibers with single fiber fineness of 0.7 dtex and fiber length of 8 mm were used for rayon fibers.

Comparative Example 1

A wet-laid nonwoven fabric was obtained by the method similar to that of Example 1 except that the ratio of the staple fibers was changed from that given in Example 1. The physical characteristics of the fully oriented staple fibers, the low oriented staple fibers and the wet-laid nonwoven fabric are shown in Table 3.

Comparative Example 2

A wet-laid nonwoven fabric was obtained by the method similar to that of Example 1 except that the bio-polyethylene terephthalate chips described in Example 1 was changed to a petroleum-derived polyethylene terephthalate chips having the same physical characteristics. The physical characteristics of the fully oriented staple fibers, the low oriented staple fibers and the wet-laid nonwoven fabric are shown in Table 3.

Comparative Example 3

(Polylactic Acid Fully Oriented Fibers)

After polylactic acid chips manufactured by NatureWorks were dried, they were melted at 225° C. and discharged at 510 g/min through a spinneret having 1008 holes and taken in at a speed of 1300 m/min to obtain polylactic acid low oriented fibers. The polylactic acid low oriented fibers were made to converge into a tow of approximately 140 thousand decitex and then, drawn in hot water to 2.4 times to obtain polylactic acid fully oriented fibers. Moreover, the polylactic acid fully oriented fibers were made to pass through aqueous emulsion (note: solid concentration at 2.0%) of the same polyether/polyester copolymer as that used in Example 1 and squeezed so that moisture content in the polylactic acid fully oriented fibers falls to approximately 12%. After that, the polylactic acid fully oriented fibers were cut at a fiber length of 5 mm without drying, drying was applied, and polylactic acid fully oriented fibers (no crimp) having single fiber fineness of 1.63 decitex were obtained.

(Polylactic Acid Low Oriented Fibers)

After polylactic acid chips manufactured by NatureWorks were dried, they were melted at 225° C. and discharged at 440 g/min through a spinneret having 3006 holes and taken in at a speed of 1000 m/min to obtain polylactic acid low oriented fibers. The polylactic acid low oriented fibers were made to converge into a tow of approximately 140 thousand decitex. After that, without drawing, the polylactic acid low oriented fibers were made to pass through aqueous emulsion (note: solid concentration at 2.0%) of the same polyether/polyester copolymer as that used in Example 1 and squeezed so that moisture content in the polylactic acid low oriented fibers falls to approximately 12%. After that, the polylactic acid fully oriented fibers were cut at a fiber length of 5 mm without drying, drying was applied, and polylactic acid low oriented fibers (no crimp) having single fiber fineness of 1.5 decitex were obtained.

(Wet-Laid Web Forming Processing, Drying Treatment and Calendering Treatment)

The polylactic acid fully oriented fibers and the polylactic acid low oriented fibers were mixed and agitated at the weight ratio of 60/40 using water as a medium and then made into 70 g/m$^2$ of paper using a manual paper machine (by Kumagai Riki Kogyo Co., Ltd., model: No. 2555, standard square sheet machine, the same applies to the following) and then, the fibers were subjected to drying treatment at 100° C. for 2 minutes by using an air-through dryer (by Kumagai Riki Kogyo Co., Ltd., model: No. 2575-II, rotary dryer (high temperature type)). After that, calendering (120° C.×200 kg/cm (1960 N/cm)) was applied by using a device composed of metal roll/metal roll, and a wet-laid nonwoven fabric was obtained. The physical characteristics of the polylactic acid fully oriented fibers, the polylactic acid low oriented fibers and the wet-laid nonwoven fabric are shown in Table 3.

Comparative Example 4

Fully oriented staple fibers were obtained by the method similar to that in Example 7 except that petroleum-derived polyethylene terephthalate chips were used instead of bio-polyethylene terephthalate chips in a process of obtaining the bio-PET fully oriented staple fibers described in Example 7 and moreover, a wet-laid nonwoven fabric was obtained by the method similar to that of Example 7. The physical characteristics of the fully oriented staple fibers and the wet-laid nonwoven fabric are shown in Table 3.

TABLE 3

| | Item | Unit | Example 1 (re-stated) | Comparative Example 2 | Comparative Example 3 | Comparative Example 4 |
|---|---|---|---|---|---|---|
| Fully oriented fiber | Polymer type | — | Bio-PET | Petroleum-derived PET | Polylactic acid | Petroleum-derived PET |
| | Single fiber fineness | dtex | 0.6 | 0.6 | 1.63 | 0.17 |
| | Fiber length | mm | 5.0 | 5.0 | 5.0 | 5.0 |
| | Fiber strength | cN/dtex | 4.5 | 4.5 | 3.36 | 2.51 |
| | Fiber elongation | % | 50 | 50 | 47.4 | 31.9 |
| | Dry heat shrinkage at 180° C. | % | 5.0 | 5.0 | Measurement impossible due to fusing | 3.2 |
| | Ratio of biomass-derived carbon content | % | 20 | 0 | 100 | 0 |
| Low oriented fiber (binder fibers) | Polymer type | — | Bio-PET | Petroleum-derived PET | Polylactic acid | None |
| | Binder fibers (type) | | UDY | UDY | UDY | — |
| | Single fiber fineness | dtex | 1.2 | 1.2 | 1.5 | — |
| | Fiber length | mm | 5.0 | 5.0 | 5.0 | — |
| | Fiber strength | cN/dtex | 0.91 | 0.91 | 1.17 | — |
| | Fiber elongation | % | 136.7 | 136.7 | 126 | — |
| | Dry heat shrinkage at 180° C. | % | Measurement impossible due to fusing | Measurement impossible due to fusing | Measurement impossible due to fusing | — |
| | Ratio of biomass-derived carbon content | % | 20 | 0 | 100 | — |

| | | | Comparative Example 1 | Comparative Example 2 | Comparative Example 3 | Comparative Example 4 |
|---|---|---|---|---|---|---|
| | Other fibers | — | — | — | — | — |
| | Raw cotton composition (fully oriented fiber/low oriented fiber/others) | mass % | 90/10/0 | 70/30/0 | 60/40/0 | 100/0/0 |
| Wet-laid nonwoven fabric | Manufacturing method | — | Wet-laid web forming method | Wet-laid web forming method | Wet-laid web forming method | Wet-laid spun lace method |
| | Rotary dryer treatment conditions | — | 120° C. × 2 min | 120° C. × 2 min | — | — |
| | Air-through dryer treatment conditions | — | — | — | 100° C. × 2 min | 130° C. × 2 min |
| | Calendering treatment conditions (metal roll/metal roll) | — | 180° C. × 200 kg/cm | 180° C. × 200 kg/cm | 120° C. × 200 kg/cm | — |
| | Weight per unit area | $g/m^2$ | 70 | 69 | 70 | 50 |
| | Thickness | mm | 0.15 | 0.11 | 0.10 | 0.08 |
| | Density | $g/cm^3$ | 0.47 | 0.63 | 0.70 | 0.63 |
| | Tensile strength | N/15 mm | 11 | 20 | 5 | 12 |
| | Web uniformity | class | 4 | 4 | 1 | 4 |
| | Ratio of biomass-derived carbon content | % | 20 | 20 | 100 | 20 |
| | Result | | The binder fiber component was insufficient and only nonwoven fabric with insufficient tensile strength was obtained. Practical use is hardly possible. | Since petroleum-derived polyester was used, the effect of reducing environmental burden is insufficient. | Reduction of environmental burden was possible and a nonwoven fabric with good web uniformity was obtained, but heat resistance of the nonwoven fabric was low and dry heat shrinkage of the nonwoven fabric was large and thus, practical use is hardly possible. | Since petroleum-derived polyester was used, the effect of reducing environmental burden is insufficient. |

UDY: Undrawing Yarn

INDUSTRIAL APPLICABILITY

According to the present invention, biomass-derived polyalkylene terephthalate staple fibers, biomass-derived polyalkylene naphthalate staple fibers, a wet-laid nonwoven fabric and a manufacturing method of the wet-laid nonwoven fabric are provided. The wet-laid nonwoven fabric of the present invention is excellent in reduction of an environmental burden, adhesive strength, and heat resistance, and its industrial values are extremely great.

In detail, in each of the above-described examples, as illustrated in Table 1, the adhesive strength as a wet-laid nonwoven fabric is sufficient since breaking length shows a sufficient value, and sufficient heat resistance/chemical resistance are provided since it is a nonwoven fabric made of polyalkylene terephthalate and/or polyalkylene naphthalate. Moreover, an environmental burden is less and matches the purpose of carbon neutrality since a predetermined amount or more of the biomass-derived components is contained. Thus, the nonwoven fabric obtained from the staple fibers according to the present invention can be suitably used for nonwoven materials for vehicles and the like requiring heat resistance and chemical resistance such as bag filters, electrical insulating material of F class or above, cell separators, separators for capacitor (super capacitor), ceiling materials, floor mats, engine filters, petroleum filters and the like.

The invention claimed is:

1. Staple fibers of polyalkylene terephthalate or polyalkylene naphthalate containing biomass-derived carbon ratio by radioactive carbon (carbon 14) measurement at 10% or more and 100% or less, single fiber fineness of 0.0001 to 7.0 decitex, and fiber length of 0.1 to 20 mm.

2. The staple fibers of polyalkylene terephthalate or polyalkylene naphthalate according to claim 1, wherein the staple fibers are fully oriented staple fibers.

3. The staple fibers of polyalkylene terephthalate or polyalkylene naphthalate according to claim 1, wherein the staple fibers are low oriented staple fibers.

* * * * *